US008358086B2

(12) United States Patent
Hani

(10) Patent No.: US 8,358,086 B2
(45) Date of Patent: Jan. 22, 2013

(54) ELECTRONIC BALLAST FOR A LAMP

(75) Inventor: Michael Hani, Bad Aibling (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 508 days.

(21) Appl. No.: 12/526,068

(22) PCT Filed: Jan. 25, 2008

(86) PCT No.: PCT/EP2008/000583

§ 371 (c)(1), (2), (4) Date: Aug. 6, 2009

(87) PCT Pub. No.: WO2008/095618

PCT Pub. Date: Aug. 14, 2008

(65) Prior Publication Data

US 2010/0026212 A1 Feb. 4, 2010

(30) Foreign Application Priority Data

Feb. 7, 2007 (DE) ..... 10 2007 006 181

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 37/00*** | (2006.01) |

(52) U.S. Cl. ..... 315/307; 315/129; 315/133; 315/291

(58) Field of Classification Search ..... None
See application file for complete search history.

(56) References Cited

U.S. PATENT DOCUMENTS 6,828,740 B2 * 12/2004 Takahashi et al. ..... 315/291
7,888,886 B2 * 2/2011 Wu ..... 315/307

FOREIGN PATENT DOCUMENTS

EP 1206168 B1 5/2003

OTHER PUBLICATIONS

International Search Report of PCT/EP2008/000583 mailed Sep. 19, 2008.

* cited by examiner

*Primary Examiner* — Anh Tran

(57) ABSTRACT

An electronic ballast for a lamp has at least one dimming value control input and a control unit configured to set the dimming value of the lamp, wherein arranged downstream of the dimming value control input are: a signal output state detecting unit configured to acquire at least one of a signal output state in which the signal level of a signal fed to the dimming value control input overshoots a predetermined limit value, and a signal output state in which it undershoots a predetermined limit value, and a measuring unit configured to measure the duration of a signal output state, the control unit configured to set a dimming value of the lamp being configured to set the dimming value on the basis of the measured duration of the signal output state.

1 Claim, 3 Drawing Sheets

ELECTRONIC BALLAST FOR A LAMP

RELATED APPLICATIONS

Figure 1:
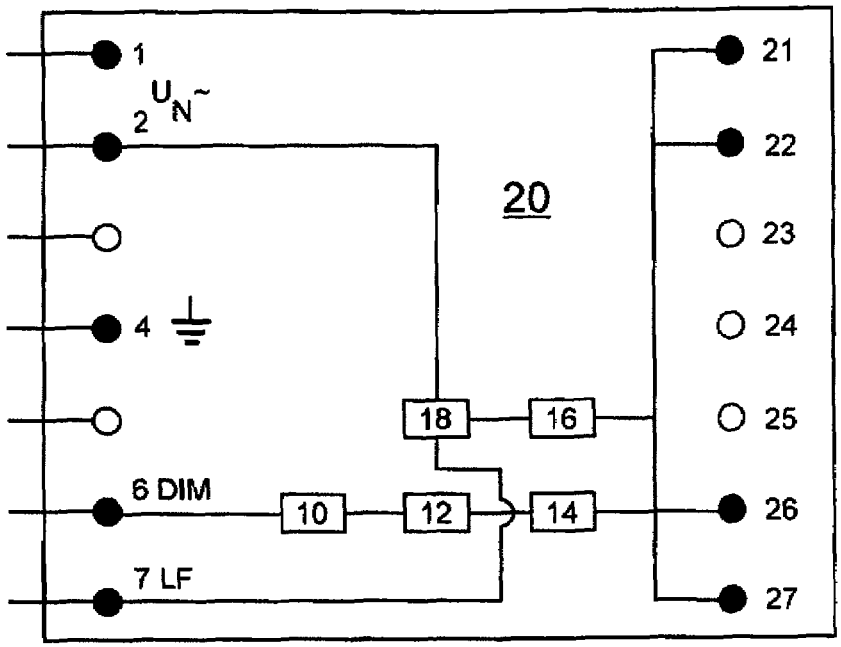

The present application is a national stage entry according to 35 U.S.C. §371 of PCT application No.: PCT/EP2008/000583 filed on Jan. 25, 2008, which claims priority from German application No.: 10 2007 006 181.3 filed on Feb. 7, 2007.

TECHNICAL FIELD

The invention relates to an electronic ballast for a lamp. The electronic ballast is intended to enable the lamp to be dimmed on the basis of an external control. To this end, it must have a dimming value control input and be provided with means for setting a dimming value of the lamp (in order to supply the latter with voltage or with the current). In accordance with another aspect of the invention, the electronic ballast is also intended to be capable of detecting a lamp fault and communicating it to the outside. To this end, it must comprise means for detecting a lamp fault (that is to say for detecting whether the lamp is faulty or not), as well as a lamp fault detection input. It is preferred for one and the same electronic ballast to unite in itself both said properties of the ability to dim the lamp and the lamp fault detection.

BACKGROUND OF THE INVENTION

In a simple embodiment of an electronic ballast in accordance with the prior art, the dimming value is set via a unidirectional dimming interface, for example a 1 . . . 10 V interface. In the case of this interface, the dimming value is defined via the level of a voltage that is present across two dimming value control inputs of the interface, or via the level of a current that flows over the interface.

For DALI devices (DALI standing for "Digital Addressable Lighting Interface") there are bidirectional dimming interfaces which generally operate digitally, as an alternative to the unidirectional dimming interface. Consequently, a dimming value control input must be sent a binary number for controlling the dimming value, by way of example a "0" standing for a switched-off lamp, and the numbers 1 to 254 being dimming values that determine the brightness of the lamp.

Both the stipulation of the dimming value via the level of a voltage or a current intensity, and the stipulation of the dimming value via a digital command are technically complicated. In particular, a respective electronic ballast specifically needs to be provided with a suitable control unit that undertakes the settings of the voltage or the current or outputs digital control signals.

The detection of lamp faults has also been performed to date with the aid of digital signals. This also appears to be troublesome, particularly as regards evaluation.

SUMMARY

The object of the present invention is to provide for a lamp an electronic ballast whose use does not require the provision of a complicated control unit.

One aspect of the disclosure is electronic ballast having the features of at least one dimming value control input and a control unit configured to set the dimming value of the lamp, wherein arranged downstream of the dimming value control input are: a signal output state detecting unit configured to acquire at least one of a signal output state in which the signal level of a signal fed to the dimming value control input overshoots a predetermined limit value, and signal output state in which it undershoots a predetermined limit value, and a measuring unit configured to measure the duration of a signal output state, the control unit configured to set a dimming value of the lamp being configured to set the dimming value on the basis of the measured duration of the signal output state. Another aspect of the disclosure is an electronic ballast having the features of at least one lamp fault detection input, and comprising a lamp fault detecting unit configured to detect a lamp fault, wherein the lamp fault detection input is configured to serve the purpose of transmitting electric current, and wherein a connection control unit is coupled to the lamp fault detecting unit configured to detect the lamp fault is provided for setting a transmission condition as a function of whether a lamp fault has been detected or not. Particularly advantageous refinements relating to electronic ballast having the features of at least one lamp fault detection input, and comprising a lamp fault detecting unit configured to detect a lamp fault, wherein the lamp fault detection input is configured to serve the purpose of transmitting electric current, and wherein a connection control unit is coupled to the lamp fault detecting unit configured to detect the lamp fault is provided for setting a transmission condition as a function of whether a lamp fault has been detected or not are to that the connection control unit is configured to enable the transmission in the case of a lamp fault, and prevent it in the case when the lamp operates satisfactorily and the connection control unit is configured to enable the transmission in the case when the lamp operates satisfactorily, and prevent it in the case of a lamp fault. Particularly advantageous is the combination of the two aspects of the invention within one and the same electronic ballast, the electronic ballast further comprising: at least one lamp fault detection input, and means for delecting a lamp fault, wherein the lamp fault detection input is designed to serve the purpose of transmitting electric current, and wherein means coupled to the means for detecting the lamp fault are provided for setting a transmission condition as a function of whether a lamp fault has been detected or not, wherein the dimming value control input and lamp fault detection input are two different inputs or the electronic ballast further comprising: at least one lamp fault detection input, and a lamp fault detecting unit configured to detect a lamp fault, wherein the lamp fault detection input is configured to serve the purpose of transmitting electric current, and wherein a connection control unit is coupled to the lamp fault detecting unit configured to detect the lamp fault is provided for setting a transmission condition as a function of whether a lamp fault has been detected or not, wherein the dimming value control input and lamp fault detection input are the same input. The signal output slate detecting unit configured to acquire a signal output state and the connection control unit configured to set a transmission condition being coupled to one another, and the connection control unit is configured to prevent the transmission of current independently of the occurrence of a lamp fault as lone as the signal output state is acquired.

Another aspect of the disclosure is that the electronic ballast comprises, at a point downstream of the dimming value control input, firstly means for acquiring a signal output state in which the signal level of a signal fed to the dimming value control input overshoots a (first) predetermined limit value and/or in which it undershoots a (second) predetermined limit value, and it further comprises means for measuring the duration of a respectively acquired signal output state. The means for setting a dimming value of the lamp are then designed in accordance with the invention to set the dimming value on the basis of the measured duration of the signal output state.

It is therefore no longer necessary, as in the prior art, to define the dimming value via the level of a voltage or a current intensity, or via the content of a digital command. It suffices to apply a specific potential to the dimming value control input, there being a need to distinguish only between the signal output state and a nonexistent signal output state, this being possible by means of said limit value criteria. It is even possible purely theoretically to apply a temporally alternating potential, there then being a need to define the maximum amplitude, or else the root-mean-square value, for example, as signal level. It is also advantageous, as against the prior art, that it is necessary to use only a single dimming value control input.

In the case of the electronic ballast for a lamp in another embodiment, according to the invention the lamp fault detection input is designed to serve the purpose of transmitting electric current. Furthermore, means coupled to the means for detecting the lamp fault are provided for setting a transmission condition as a function of whether the lamp fault has been detected or not.

An electronic ballast in accordance with this aspect of the invention therefore does not operate with digital signals that are used to inform a control device of the detection of a lamp fault. Rather, there is a need only to apply an appropriate voltage (for example, between lamp fault detection input and ground). The means for setting a transmission condition then permit the transmission or not, depending on the occurrence of a lamp fault. If a multiplicity of such electronic ballasts are connected in parallel to a voltage source, a central control unit can measure the electric current flowing and establish, on the basis of the current intensity, how many of the electronic ballasts enable the transmission, and how many do not. It can thereby be determined how many electronic ballasts have detected a lamp fault.

In the case of an alternative to this, the transmission of current is enabled in the case of a lamp fault, and prevented in the normal case that the lamp is operating satisfactorily. Conversely, it is also possible, however, to provide the transmission in the normal case of the satisfactory operation of the lamp, and prevention in the case of a lamp fault.

Again, in the case of the aspect of the present invention in which the detection of a lamp fault is communicated by the transmission of electric current, it is advantageous that there is a need to provide only a single input, specifically one lamp fault detection input via which the current flows.

It is therefore a common feature of the electronic ballast in accordance with the first aspect, which has the single dimming value control input, and the electronic ballast in accordance with the second aspect of the invention, which has the single lamp fault detection input, that the provision of a small number of inputs is enabled. Furthermore, it is a common feature of the two aspects that the respectively required control units can be of simple design.

The two aspects of the invention can be implemented in a single electronic ballast and preferably are. In accordance with an embodiment, the dimming value control input and lamp fault detection input are two different inputs. This embodiment has the advantage of its simplicity. As against the prior art, however, the total number of the inputs is nevertheless limited, because it is necessary to operate with only one input in the case of each aspect (dimming value control input on the one hand, and lamp fault detection input on the other hand).

In the case of another embodiment, it is provided for the purpose of saving on inputs that the dimming value control input and lamp fault detection input are precisely the same input. Of course, it is then necessary to take a measure as to how the functionalities can be separated from one another. This is done by coupling to one another the means for acquiring a signal output state and the means for setting a transmission condition. It is then provided beyond situations to date of the prevention of transmission of current that the means for setting prevent the transmission of current independently of the occurrence of a lamp fault as long as the signal output state is acquired.

BRIEF DESCRIPTION OF THE DRAWING(S)

Figure 3:
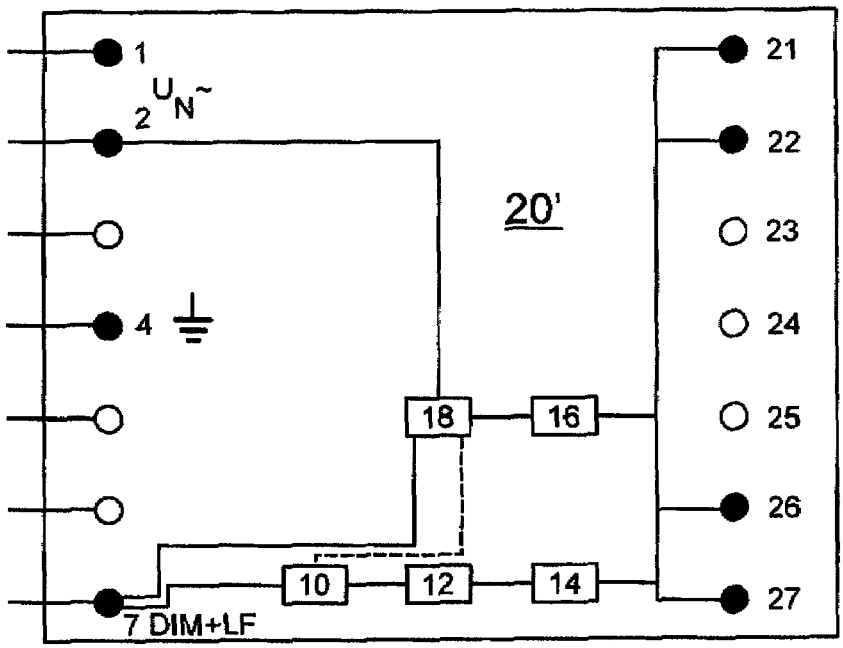
Figure 2:
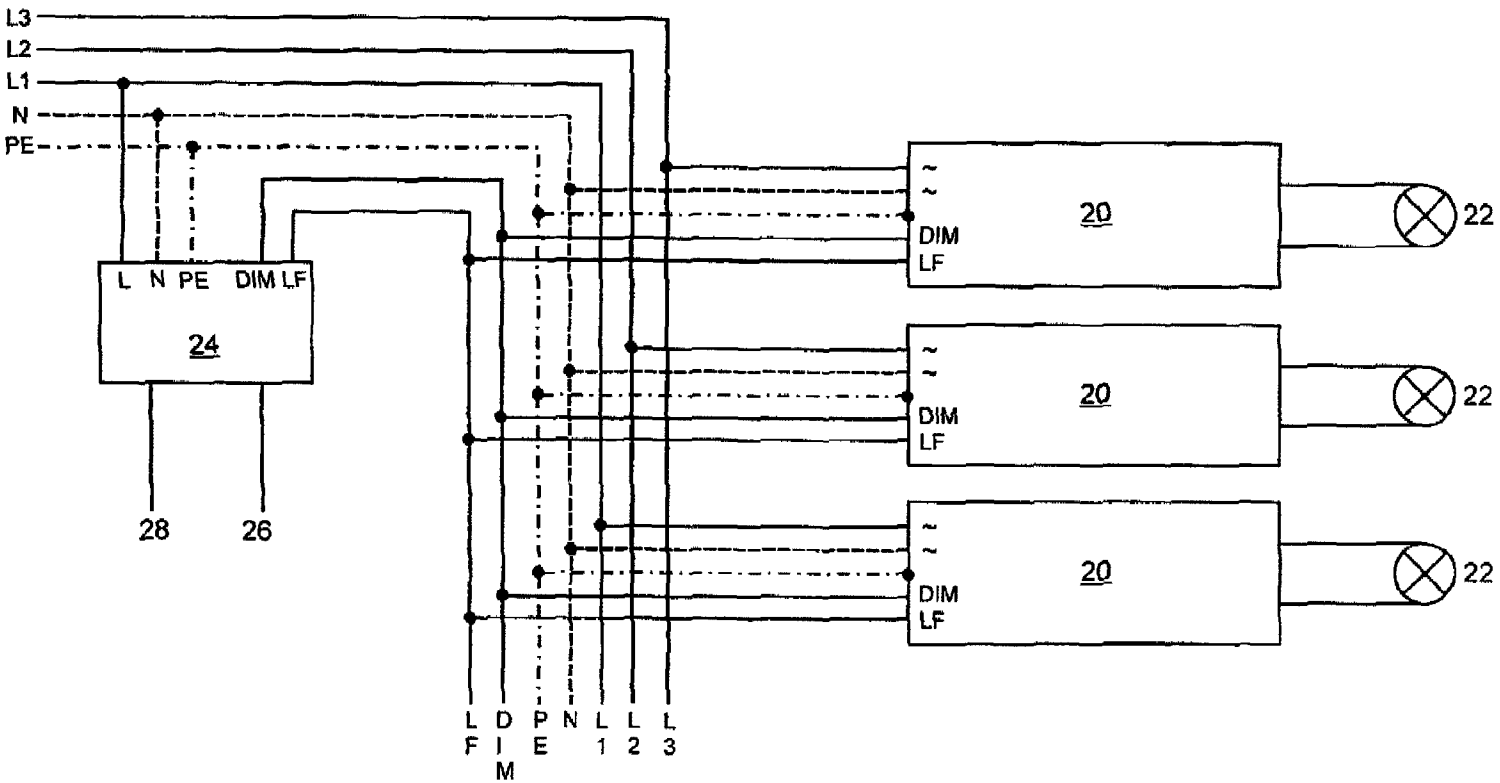
Figure 4:
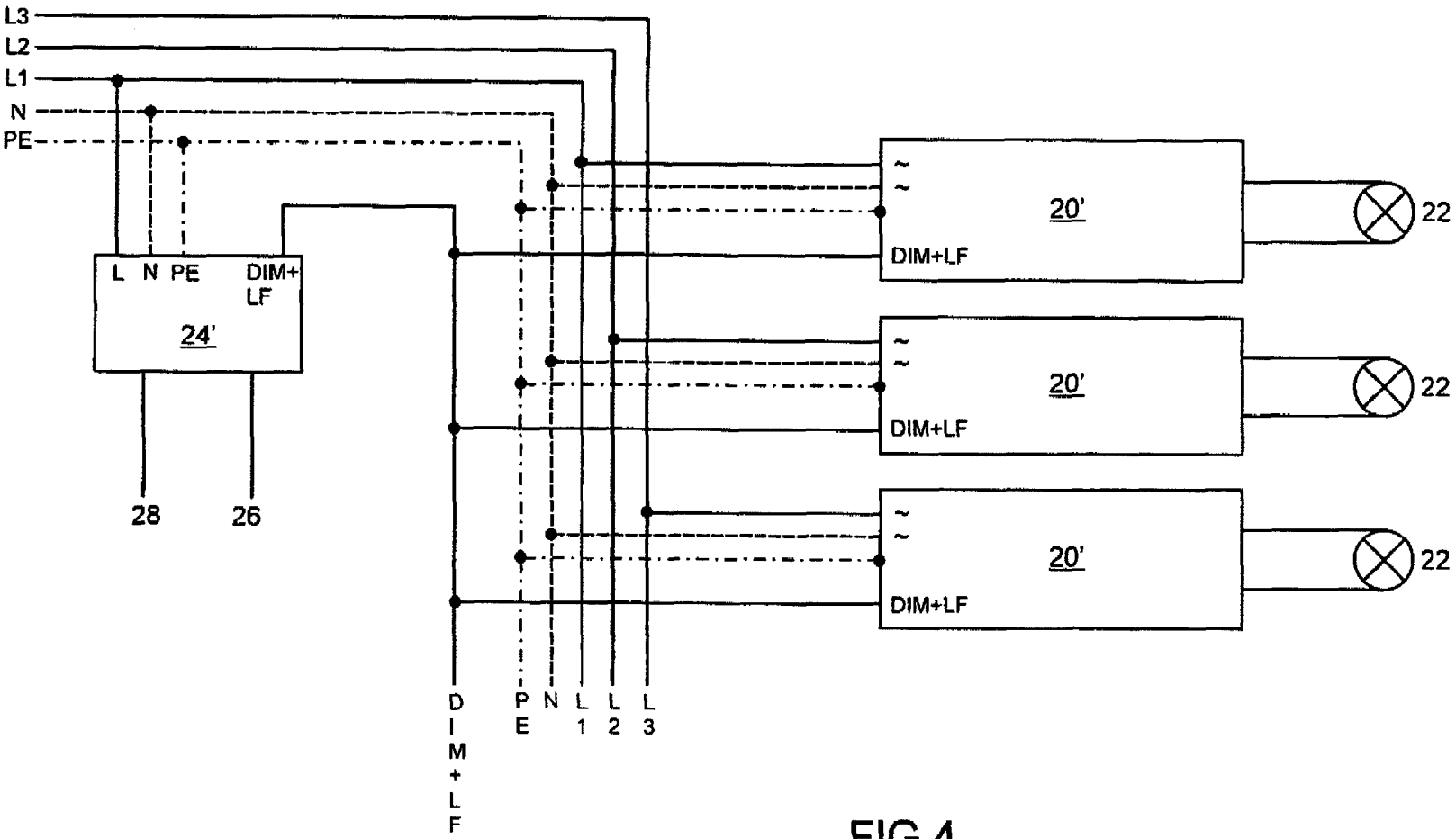

The aim below is to explain the invention in more detail with the aid of a plurality of exemplary embodiments. In the drawing:

FIG. 1 shows an electronic ballast in accordance with a first aspect of the invention, having inputs, outputs and a schematically indicated internal arrangement, FIG. 2 shows the interconnection of operating devices in accordance with the first aspect of the invention, FIG. 3 shows an electronic ballast in accordance with a second aspect of the invention, having inputs, outputs and a schematically indicated internal arrangement, and FIG. 4 shows the interconnection of operating devices in accordance with the second aspect of the invention.

DETAILED DESCRIPTION

An electronic ballast 20 shown in FIG. 1, that is also denoted as operating device, has two inputs for the voltage supply that are denoted by 1 and 2, and a grounding terminal, which is denoted by 4. Outputs 21, 22, 26 and 27 lead to the luminous means, that is to say, for example, to a lamp that is to be driven by the electronic ballast. The electronic ballast enables the luminous means not only merely to be switched on or off, but also to be dimmed, that is to say to be operated with a light value that is lower than maximum. The way in which the electronic ballast is informed how strongly the luminous means is to be dimmed is a particular characteristic of the inventive electronic ballast. For the purpose of stipulating the light value, the electronic ballast comprises a single dimming input that is denoted here by 6 and is labeled with the letters "DIM" for explanatory purposes. The light value is stipulated by applying a specific level to the input 6 for a predetermined duration. The unit 10 in the electronic ballast detects whether a so-called signal output state is present, that is to say whether the level at the input 6 has exceeded a predetermined limit value or not. A measuring unit 12 measures how long the signal output state exists. Arranged downstream of the measuring unit is a unit 14 that undertakes the appropriate control at the outputs 21, 22, 26 and/or 27 that lead to the luminous means. The unit 14 acquires the value measured by the unit 12 as regards the duration of the signal output state, and interprets said value
as dimming value. The luminous means is correspondingly driven by this unit 14.

The electronic ballast likewise has the task moreover of detecting via a unit 16, for example with the aid of the current flow via the outputs 21, 22, 26 and 27, whether the luminous means is functionally capable or effective, that is to say whether a lamp fault is present or not. A unit 18 is coupled to the unit 16. The unit 18 controls a connection between an input 7 and one of the connections 1 and 2, preferably the one that is connected to the neutral conductor. The input 7 serves the purpose of communicating a fault in the luminous means to an external control unit, and is therefore also labeled with "LF" for fault in luminous means (or else lamp fault). A characteristic of the inventive electronic ballast (operating device) is that a current can flow via the input 7. It is provided that this current flows precisely when a fault has occurred in the luminous means, and does not flow precisely when the luminous means is intact. The unit 18 connected between input 7 and input 1 or 2 serves the purpose of setting a transmission condition as a function of whether the unit 16 has detected a fault in the luminous means or not.

FIG. 2 illustrates how a plurality of operating devices 20 can be connected in an arrangement of the type of the operating device shown in FIG. 1. Each operating device 20 is assigned a lamp 22 as luminous means. A control unit 24 is provided for all operating devices. A coupling is made to a customary power supply with three phase conductors L1 to L3, the neutral conductor N and ground PE. All operating devices are connected to the neutral conductor N and ground PE. The operating devices are alternately connected to the different phase conductors L1, L2 and L3 so that none of the phases is too heavily loaded. The control unit 24 is connected, by way of example, to the phase conductor L1, in addition to the connection to the neutral conductor N and ground PE.

Additional lines DIM for stipulating the light value and LF for detecting the fault in the luminous means are provided. Operating elements 26 are coupled to the control unit 24. The control unit 24 is optionally also coupled to an upstream building management controller 28. Since, as explained above, the dimming input DIM (input 6 from FIG. 1) merely has to receive only a signal of predetermined potential for a duration that prescribes the dimming value, the operating elements 26 can, for example, comprise or be conventional keys such as are known for stipulating the dimming value and which the operator must press for a predetermined time period. The operating devices (electronic ballasts) 20 can be designed to this end such that the respective units 14 already become active as long as the level is sensed, such that at one of the operating devices 20 the operator initiates dimming of the luminous means 22 directly, as it were, by pressing a key 26.

The control unit is also connected to a dedicated conductor LF in order to detect the fault in the luminous means. It is intended that current be able to flow through this conductor. As explained above, the individual operating devices 20 enable current to flow through via the input 7 (LF) in the case when a fault has occurred in the luminous means. The control unit 24 is to be designed for the purpose of measuring the height of the current flowing via the line LF. Each of the operating devices 20 that has a fault in the luminous means draws in a predetermined quantity of current. It is therefore possible for the number of the operating devices that have detected a fault in the luminous means to be inferred from the total current intensity.

There is also a modified form of the operating device 20 that is shown in FIG. 3 and denoted there by 20'. In this embodiment, a simple input, here the input 7, serves both to stipulate the light value and to detect the error in the luminous means. This input is therefore denoted by "DIM+LF".

In principle, the electronic ballast 20' is arranged in the interior exactly as explained above in relation to the operating device 20 from FIG. 1, that is to say both the units 10, 12 and 14 and the unit 18 coupled to the unit 16 are arranged downstream of the input of the DIM+LF. The units 10 and 18 are intercoupled so that there are no conflicts between the functions of setting the dimming value and reporting the fault in the luminous means. The unit 10 senses that there is a signal output state, the stipulation of the light value is given precedence over the reporting of the fault in the luminous means, and the unit 18 prevents current from flowing via the input 7.

An arrangement consisting of a plurality of such operating devices 20' is shown in FIG. 4. Since the inputs DIM+LF of the operating device 20 are combined to form the input DIM+LF in the case of the operating device 20', there is also only a single line DIM+LF remaining that is connected to these inputs, and the control unit 24 is also changed to form the control unit 24', which has only a single output DIM+LF to the line DIM+LF. As for the rest, the operating devices 20' are connected to the conductors exactly as are the operating devices 20 from FIG. 2.

For one thing, the invention provides a simple possibility of prescribing the dimming value, specifically via simple keys 26, the unit 10 being required to distinguish only between two states, specifically the signal output state and the nonexistent signal output state, the unit 12 then being required to measure the duration of the presence of the signal output state, the dimming value then being prescribed for the unit 14. The detection of the fault in the luminous means is no longer performed via digital signals as in the prior art, but rather via a flowing current that can easily be measured by the control units 24 and 24', respectively. All that need be ensured is that a unit 18 define the transmission condition for the current as a function of a fault in the luminous means that is determined by the unit 16.

The invention claimed is:

1. An electronic ballast for a lamp, comprising:

at least one dimming value control input and a control unit configured to set the dimming value of the lamp, wherein arranged downstream of the dimming value control input are:

a signal output state detecting unit configured to acquire at least one of a signal output state in which the signal level of a signal fed to the dimming value control input overshoots a predetermined limit value, and signal output state in which it undershoots a predetermined limit value, and a measuring unit configured to measure the duration of a signal output state, the control unit configured to set a dimming value of the lamp being configured to set the dimming value on the basis of the measured duration of the signal output state;

further comprising:

at least one lamp fault detection input, and a lamp fault detecting unit configured to detect a lamp fault, wherein the lamp fault detection input is configured to serve the purpose of transmitting electric current, and wherein a connection control unit is coupled to the lamp fault detecting unit configured to detect the lamp fault is provided for setting a transmission condition as a function of whether a lamp fault has been detected or not, wherein the dimming value control input and lamp fault detection input are the same input, the signal output state detecting unit configured to acquire a signal output state and the connection control unit configured to set a transmission condition being coupled to one another, and the connection control unit is configured to prevent the transmission of current independently of the occurrence of a lamp fault as long as the signal output state is acquired.

* * * * *